US008197766B2

(12) United States Patent
Tomosue et al.

(10) Patent No.: US 8,197,766 B2
(45) Date of Patent: Jun. 12, 2012

(54) CATALYTIC CONVERTER, HOLDING MATERIAL FOR CATALYTIC CONVERTER AND PRODUCTION METHOD THEREOF

(75) Inventors: Nobuya Tomosue, Tokyo (JP); Junya Sato, Tokyo (JP); Kazutoshi Isomura, Tokyo (JP)

(73) Assignee: Nichias Corporation, Tokyo (JP)

( * ) Notice: Subject to any disclaimer, the term of this patent is extended or adjusted under 35 U.S.C. 154(b) by 678 days.

(21) Appl. No.: 12/222,448

(22) Filed: Aug. 8, 2008

(65) Prior Publication Data

US 2009/0041638 A1 Feb. 12, 2009

(30) Foreign Application Priority Data

Aug. 9, 2007 (JP) ..... P. 2007-207932

(51) Int. Cl.
*B01D 50/00* (2006.01)

(52) U.S. Cl. ..... 422/179

(58) Field of Classification Search ..... 422/177, 422/179, 180

See application file for complete search history.

(56) References Cited

U.S. PATENT DOCUMENTS

| | | | |
|---|---|---|---|
| 4,985,212 | A | 1/1991 | Kawakami et al. |
| 2004/0062690 | A1 | 4/2004 | Tanaka et al. |
| 2007/0033803 | A1 | 2/2007 | Lawrukovich et al. |

FOREIGN PATENT DOCUMENTS

| | | | |
|---|---|---|---|
| EP | 0 997 618 | A3 | 1/2003 |
| JP | 1-247711 | | 10/1989 |
| JP | 2001-65337 | A | 3/2001 |
| JP | 2001-518589 | | 10/2001 |
| JP | 2003-262117 | | 9/2003 |
| JP | 2003-293756 | | 10/2003 |
| JP | 2006-223920 | | 8/2006 |
| JP | 2006-524777 | | 11/2006 |
| JP | 2007-162583 | | 6/2007 |
| WO | WO 2004/094794 | A1 | 11/2004 |

OTHER PUBLICATIONS

Notice of Reasons for Rejection and English translation in JP 2007-207932 mailed Mar. 8, 2011.

Examination Report Mailed May 13, 2011 in Great Britain Application No. GB 0814477.6 (3 pages).

*Primary Examiner* — Tom Duong

(74) *Attorney, Agent, or Firm* — Nixon & Vanderhye P.C.

(57) ABSTRACT

The present invention relates to a holding material for a catalytic converter including a catalyst carrier, a metal casing for receiving the catalyst carrier, and the holding material wound around the catalyst carrier and interposed in a gap between the catalyst carrier and the metal casing, the holding material having a plurality of high-density sites which are spaced apart from one another in the holding material, each site having a higher density than sites of the holding material in which the higher density sites are not provided.

4 Claims, 5 Drawing Sheets

(A)

(B)

CATALYTIC CONVERTER, HOLDING MATERIAL FOR CATALYTIC CONVERTER AND PRODUCTION METHOD THEREOF

FIELD OF THE INVENTION

The present invention relates to a catalytic converter (also referred to as an exhaust gas purifying apparatus) for removing particulates, carbon monoxide, hydrocarbons, nitrogen oxides and the like contained in exhaust gas discharged from an internal combustion engine such as a gasoline engine or a diesel engine, a holding material for a catalytic converter for holding a catalyst carrier in a metal casing and a production method thereof.

BACKGROUND OF THE INVENTION

In exhaust systems of internal combustion engines, there are disposed exhaust purifying apparatus such as a catalytic converter, a diesel particulate trapping apparatus and an $NO_x$ occluding-purifying apparatus. FIG. 1 is a cross-sectional view showing an example of a catalytic converter 10 which is an example of these exhaust purifying apparatus. In this catalytic converter 10, an introduction pipe 16 through which exhaust gas discharged from an internal combustion engine is introduced is connected to one end of a metal casing 11, and a discharge pipe 17 through which the exhaust gas which has passed through a catalyst carrier 12 is discharged outside is attached to the other end thereof. Further, the catalyst carrier 12 is provided inside the metal casing 11 with the intervention of a holding material 13 for a catalyst converter. Furthermore, an electric heater and a temperature sensor for burning particulates accumulated in the catalyst carrier, namely a honeycomb filter, to recover a filtering function (also referred to as regeneration treatment) may be provided on an exhaust gas introduction side (also referred to as a suction side) with respect to a catalyst carrier, and another pipe for feeding combustion air may be connected thereto, although not shown in the figure. According to such constitution, when the amount of the particulates accumulated in the catalyst carrier 12 increases to result in an increase in pressure drop, the regeneration treatment can be conducted.

The metal casing 11 can be constituted as to divide a cylindrical body into two parts along a longitudinal direction thereof, as shown in FIG. 2. The catalyst carrier 12 around which the holding material 13 for a catalyst converter has been wound is located at a predetermined position in a lower shell 22*b*, and an upper shell 22*a* is placed on the lower shell 22*b* so that a through hole 23*a* formed in an upper fixing portion 23 is exactly superimposed on a through hole 24*a* formed in a lower fixing portion 24. A bolt 25 is inserted through the through holes 23*a* and 24*a*, and fixed by a nut or the like. Alternatively, the upper fixing portion 23 and the lower fixing portion 24 may be welded with each other. Further, the metal casing 11 may be a cylindrical body 50 as shown in FIG. 3. Although this requires no assembling work necessary for the metal casing having the two-divided structure as shown in FIG. 2, it is necessary to press the catalyst carrier 12 around which the holding material 13 for a catalytic converter has been wound into the cylindrical body from an opening 51 thereof.

The holding material 13 for a catalytic converter is required to hold the catalyst carrier 12 and to block a gap between the metal casing 11 and the catalyst carrier 12. For example, holding force has been enhanced by forming high-density sites higher in density than the other sites in a stripe shape throughout the length along the axial direction of the catalyst carrier (see JP-A-1-247711) or forming high-density sites along the circular shape in a circumferential direction of the catalyst carrier (see JP-A-2003-262117).

SUMMARY OF THE, INVENTION

Since the high-density sites are formed by compressing inorganic fibers more strongly than the other sites, the inorganic fibers break to increase mat damage. Accordingly, when the high-density sites are continuously formed in an axial direction or in a circumferential direction, there is a concern that cracks occur along boundaries between the high-density sites and the other sites. In particular, when a cylindrical metal casing as shown in FIG. 3 is used, the high-density sites act as resistance at the time of insertion under pressure, which causes a large force to be applied. Accordingly, cracks are liable to occur along the above-mentioned boundaries.

Further, since the catalyst carrier is made of a ceramic and has a thin honeycomb structure, when the catalyst carrier is mounted in the metal casing, it receives a large pressing force from the high-density sites of the holding material for a catalytic converter to cause a possibility of the occurrence of cracks along the high-density sites. Furthermore, when the cylindrical metal casing is used, an excess force is also applied to the catalyst carrier, associated with failure insertion of the holding material for a catalytic converter at the time of insertion with pressure, which causes a possibility of the occurrence of cracks or breakage also in the catalyst carrier In addition, since the large area of the high-density sites necessitates a large amount of a material such as the inorganic fibers, there is also a problem of causing an increase in cost.

It is therefore an object of the invention to provide a holding material for a catalytic converter excellent in holding force for a catalyst carrier, capable of preventing the occurrence of cracks in the catalyst carrier at the time when mounted in a metal casing, easily press fittable even in a cylindrical metal casing, and inexpensive. Further, another object of the invention is to provide a catalytic converter having no crack in a catalyst carrier and excellent in safety.

In order to solve the above-mentioned problems, the invention provides the following catalytic converter, holding material for a catalytic converter and method for producing the same:

(1) A holding material for a catalytic converter comprising a catalyst carrier, a metal casing for receiving the catalyst carrier, and the holding material wound around the catalyst carrier and interposed in a gap between the catalyst carrier and the metal casing, the holding material having a plurality of high-density sites which are spaced apart from one another in the holding material, each site having a higher density than sites of the holding material in which the higher density sites are not provided;

(2) The holding material according to (1), wherein the total area of the high-density sites accounts for 10 to 80% of the total area of the holding material;

(3) The holding material according to (1) or (2), which has a constant thickness;

(4) The holding material according to any one of (1) to (3), which has a thickness of 5 to 30 mm and a density as the whole holding material of 0.1 to 0.6 g/cm$^3$;

(5) The holding material according to (4), which has a density of the high-density sites of 0.20 to 0.7 g/cm$^3$;

(6) A method for producing a holding material for a catalytic converter comprising:

pouring an aqueous slurry containing inorganic fibers into a mold in which concave portions are formed in portions corresponding to high-density sites, performing dehydration molding to form a wet formed article; and drying the wet formed article while compressing the whole wet formed article in a thickness direction; and (7) A catalytic converter comprising a catalyst carrier, a metal casing for receiving the catalyst carrier, and a holding material wound around the catalyst carrier and interposed in a gap between the catalyst carrier and the metal casing, the holding material having a plurality of high-density sites which are spaced apart from one another in the holding material, each site having a higher density than sites of the holding material in which the higher density sites are not provided.

In the holding material for a catalytic converter of the invention, since the high-density sites are not continuous, and formed in a dotted shape, the holding material has holding force which is by no means inferior to that of a conventional holding material for a catalytic converter having high-density sites. Moreover, even in a state where the holding material is wound around the catalyst carrier and mounted in the metal casing, a high pressing force caused by the high-density sites is only applied to the catalyst carrier in a dotted shape, and there is no concern that the catalyst carrier cracks along the high-density sites. Further, in the case of insertion under pressure into the cylindrical metal casing, failure insertion does not occur, and the holding material per se and the catalyst carrier can be prevented from cracking. Furthermore, since the area of the high-density sites is small, cost thereof is low.

Accordingly, also in the catalytic converter provided with the holding material for a catalytic converter of the invention, the catalyst carrier is well held without the occurrence of cracks. Further, there is no leakage of exhausted gas.

DESCRIPTION OF REFERENCE NUMERALS AND SIGNS

Figure 1:
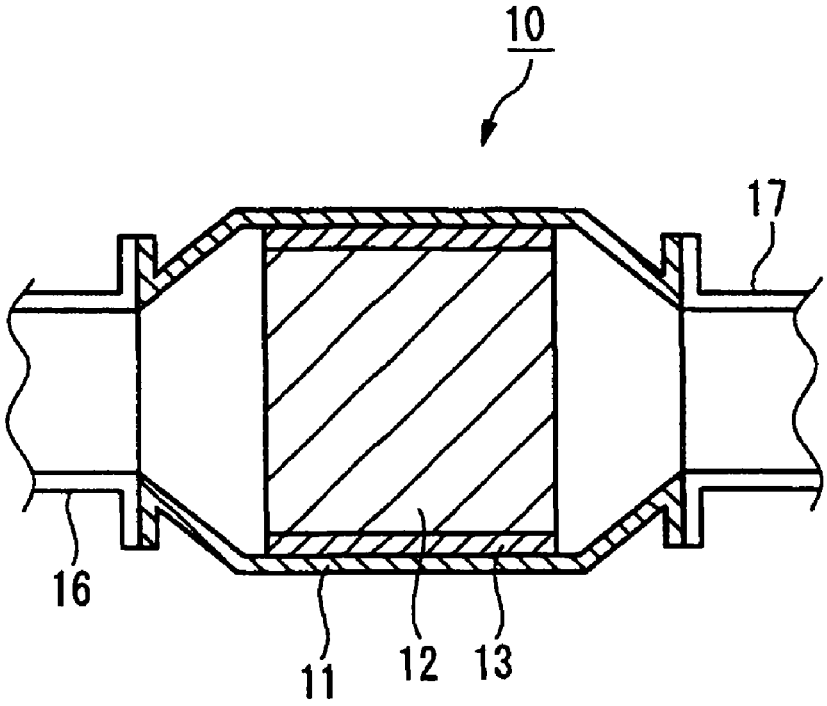
FIG. 1 is a cross-sectional view showing an embodiment of a catalytic converter.
Figure 2:
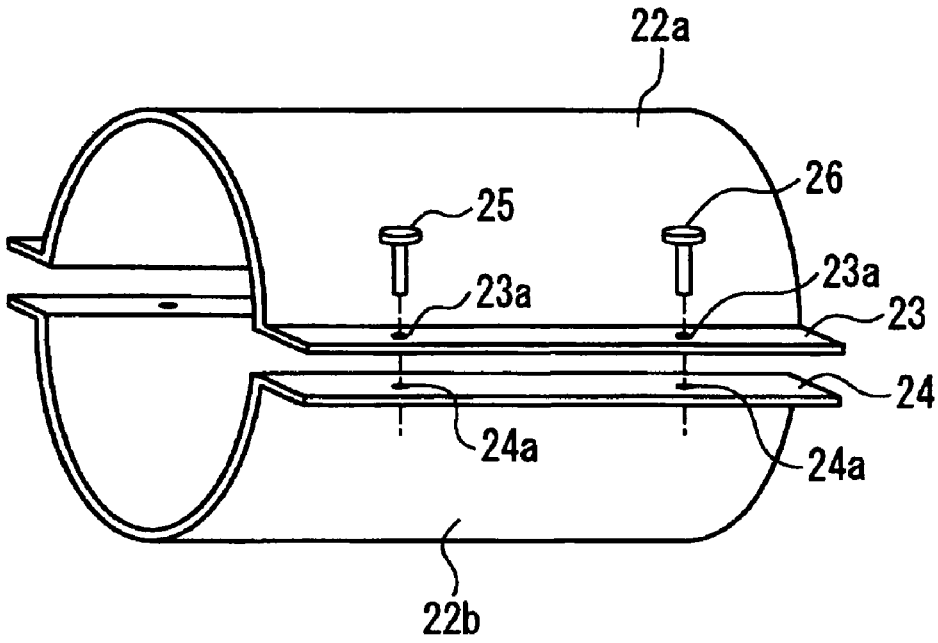
FIG. 2 is an exploded view showing an embodiment of a metal casing.
Figure 3:
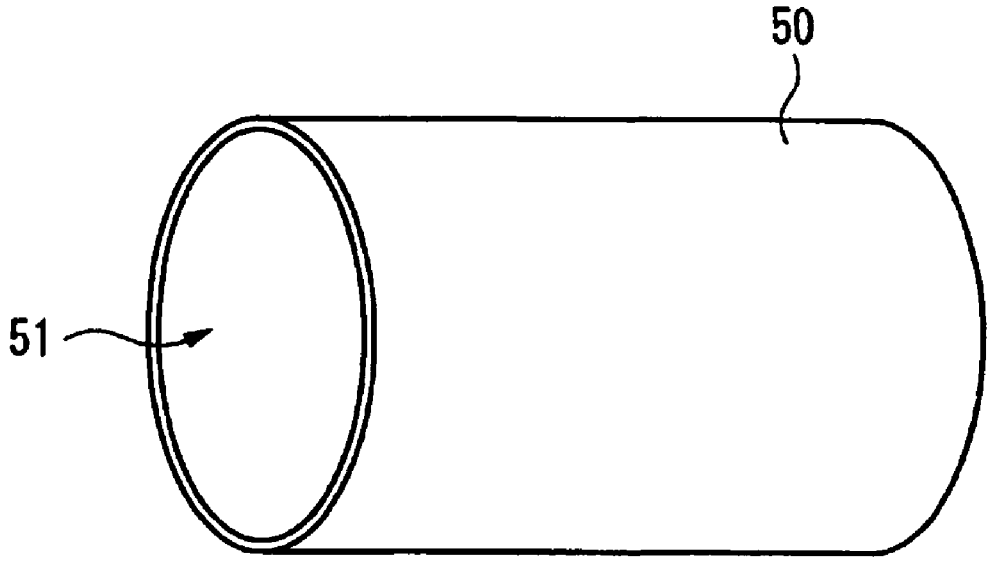
FIG. 3 is a perspective view showing another embodiment of a metal casing.

11 Metal Casing
12 Catalyst Carrier
13 Holding Material for Catalytic Converter
30 High-Density Sites

DETAILED DESCRIPTION OF THE INVENTION

The invention will be described in detail below.

Although the holding material for a catalytic converter of the invention is an inorganic fiber mat as a whole, the holding material is dotted with high-density sites that have higher density than the other sites. There is no restriction on the overall shape. For example, as shown in FIG. 4(A), it can be a shape in which a convex portion 42 is formed on one end of a tabular main body portion 41, and a concave portion 43 having a shape fittable with a shape of the convex portion 42 is formed on the other end. The shape of the convex portion 42 and the concave portion 43 may be triangular or semicircular, as well as the rectangular shape shown in the drawing. Further, the number of the convex portion 42 and the concave portion 43 is not limited to one, and may be two or more.

Figure 4:
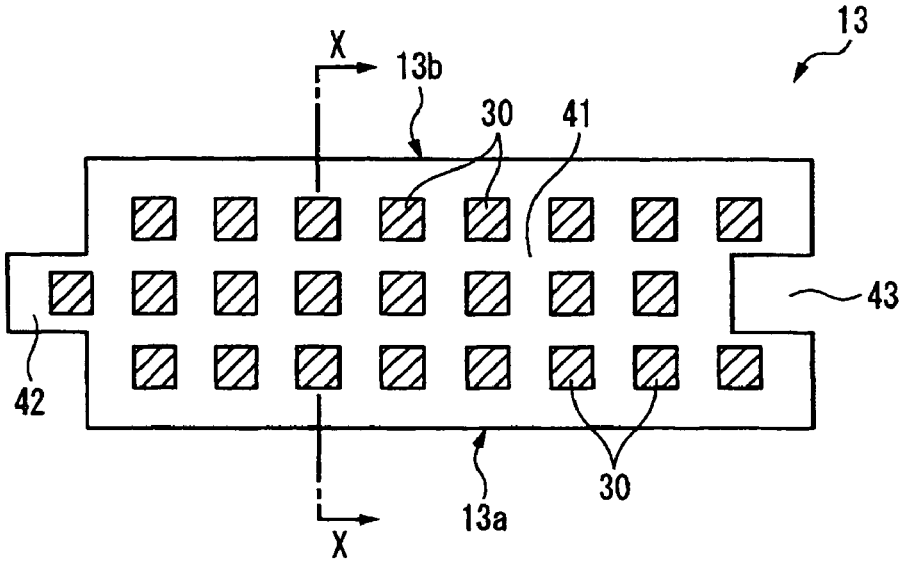
FIG. 4(A) is a plan view showing one embodiment of a holding material for a catalytic converter of the invention.
FIG. 4(B) is a perspective view showing a state where the holding material is wound around a catalyst carrier.
Figure 4:
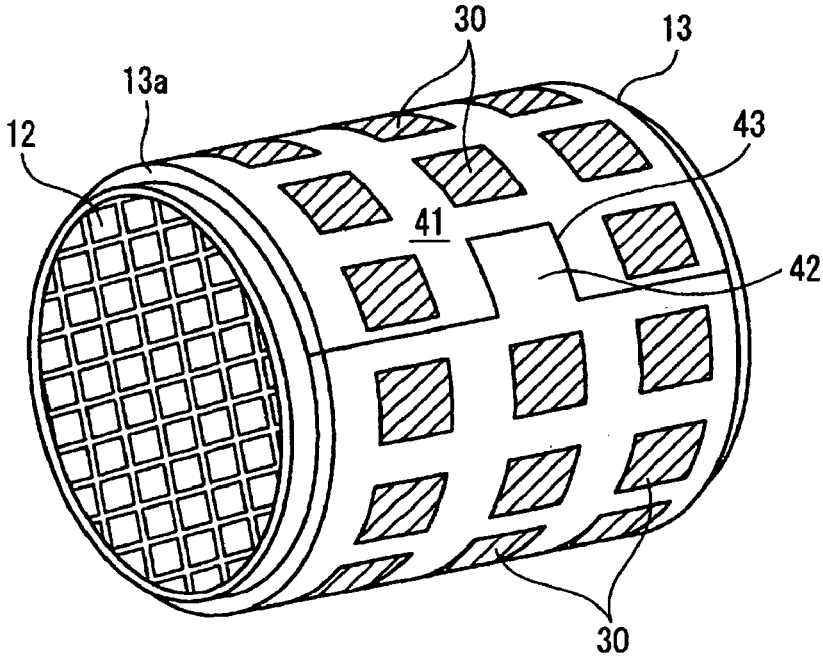

There is no restriction also on the shape and arrangement of high-density sites 30, and square high-density sites can be arranged at even intervals, as shown in FIG. 4 (A). Further, although not shown in the figure, the high-density sites 30 may be rectangular, circular, ellipsoidal, polygonal or indeterminate form, and can also be irregularly arranged. FIG. 4(B) is a view showing a state where the holding material 13 is wound around a catalyst carrier 12, and the high-density sites 30 are discontinuously arranged in both directions of the circumferential direction and the axial direction of the catalyst carrier 12. Accordingly, compared to a holding material for a catalytic converter with high-density sites continuously arranged in the axial direction or the circumferential direction, cracks are hard to occur along the high-density sites of the holding material itself and the catalyst carrier 12.

In order to secure a required holding force while preventing the above-mentioned occurrence of the cracks, the total area of the high-density sites 30 accounts for preferably 10 to 80%, more preferably 20 to 70% and still more preferably 30 to 70%, of the total area of the holding material. In particular, in the case of exceeding 80%, the thermal conductivity becomes too high as the whole holding material for a catalytic converter, resulting in poor heat insulation performance. Further, the high-density sites 30 are preferably formed a predetermined distance apart from end faces 13*a* and 13*b* becoming insertion ends when inserted into the cylindrical metal casing 11 under pressure. When the holding material is inserted into the cylindrical metal casing under pressure, the high-density sites 30 acts as resistance, so that when the high-density sites 30 are formed on the end faces 13*a* and 13*b*, there is a concern of damaging the holding material per se and the catalyst carrier 12 by failure insertion.

There is no particular restriction on the area of each high-density site 30, as long as a required holding force is secured. It is sufficient that the area is at least 0.5 $cm^2$. Further, the upper limit thereof varies depending on the size of the holding material, so that no specific numerical value can be mentioned. However, for example, the one side length in the case of a square-shape high-density site and the diameter in the case of a circle-shape high-density site is 1/10 to 1/3 the width (the length of the shorter one) of the holding material.

The density of the high-density sites 30 is preferably from 1.3 to 10 times that of the other sites, more preferably from 1.5 to 7 times, and still more preferably from 1.5 to 5 times. When this density ratio is less than 1.5 times, a substantial increase in the holding force of the catalyst carrier 12 due to a condensation and rarefaction effect will not be given. On the other hand, when it exceeds 10 times, there is a concern that the inorganic fibers break at the time of increasing the density in the production, and further, there is also a concern that cracks occur at boundaries with the other sites because the difference in density from the other sites is too large. There is no particular restriction on the density of the high-density sites 30, as long as the density of the holding material at the time of canning described later is satisfied. Specifically, the density of the holding material is preferably from 0.20 to 0.7 $g/cm^3$, and more preferably from 0.4 to 0.65 $g/cm^3$.

It is preferred that the holding material for a catalytic converter has a smaller thermal conductivity. However, heat is easily transmitted in the high-density sites 30, because the inorganic fibers are densely present. In order to compensate for it, low-density sites which are lower in density than the high-density sites are formed in the other sites. There is no particular restriction on the density of such low-density sites, as long as it can provide heat insulation properties and sealing properties as the holding material. Further, in order to more surely prevent the occurrence of cracks at boundaries between the high-density sites 30 and the low-density sites, intermediate-density sites lower in density than the high-density sites 30 and higher in density than the low-density sites may be formed in the other sites.

Taking into consideration the holding force, heat insulation performance, sealing performance and the like, the density of the whole holding material for a catalytic converter before canning is preferably from 0.1 to 0.6 g/cm$^3$, and more preferably from 0.13 to 0.3 g/cm$^3$.

Further, taking into consideration the holding force, heat insulation performance, sealing performance and the like, it is preferred that the holding material for a catalytic converter has a constant thickness. Specifically, it is adjusted within ±15%. The thickness may be from 5 to 30 mm, preferably from 6 to 12 mm.

Furthermore, a reinforcing layer comprising a nonwoven fabric, a resin sheet, a resin coating or the like may be attached to the holding material for a catalytic converter as needed. In addition, the whole may be needled.

The holding material for a catalytic converter of the invention can be produced in accordance with a conventional method for producing an inorganic fiber mat. For example, an aqueous slurry containing inorganic fibers and a binder is introduced into a mold, dehydrated by suction to form a wet formed article, and dried while uniformly compressing the whole wet formed article in a thickness direction thereof, thereby providing the holding material. At the time of molding, by using a mold in which concave portions are formed in portions corresponding to high-density sites, a wet formed article in which portions corresponding to the concave portions are projected is obtained, and the whole is compressed in the thickness direction thereof, thereby forming high-density sites and the other sites.

As the inorganic fibers, various inorganic fibers which have hitherto been used in holding materials can be used. For example, alumina fiber, mullite fiber and other ceramic fibers can be appropriately used. More specifically, as the alumina fiber, for example, one containing 90% or more by weight of $Al_2O_3$ (the remainder is $SiO_2$) and having low crystallinity in terms of X-ray crystallography is preferred. Specifically, the crystallinity of the alumina fiber is 30% or less, preferably 15% or less, more preferably, 10% or less. Further, the fiber diameter thereof is preferably from 3 to 15 μm, or 3 to 7 μm, and the wet volume thereof is preferably 200 cc/5 g or more. As the mullite fiber, for example, one having a mullite composition in which the weight ratio of $Al_2O_3/SiO_2$ is about 72/28 to 80/20 and having low crystallinity in terms of X-ray crystallography is preferred. Specifically, the crystallinity of the mullite fiber is 30% or less, preferably 15% or less, more preferably, 10% or less. Further, the fiber diameter thereof is preferably from 3 to 15 μm, or 3 to 7 μm, and the wet volume thereof is preferably 200 cc/5 g.

The above-mentioned wet volume is calculated by the following method having the following steps:

(1) 5 grams of a dried fiber material is weighed by weigher with accuracy of two or more decimal places;

(2) The weighed fiber material is placed in a 500 g glass beaker;

(3) About 400 cc of distilled water having a temperature of 20 to 25° C. is poured into the glass beaker prepared in the step (2), and stirring is carefully performed by using a stirrer so as not to cut the fiber material, thereby dispersing the fiber material. For this dispersion, an ultrasonic cleaner may be used;

(4) The content of the glass beaker prepared in the step (3) is transferred into a 1,000 ml graduated measuring cylinder, and distilled water is added thereto up to the scale of 1,000 cc;

(5) Stirring of the graduated measuring cylinder prepared in the step (4) is performed by turning the cylinder upside down while blocking an opening of the graduated measuring cylinder with the palm of a hand carefully to prevent water from leaking out. This procedure is repeated 10 times in total;

(6) the sedimentation volume of fiber is measured by visual observation after placing the graduated measuring cylinder quietly under room temperature for 30 minutes after the stop of the stirring; and (7) The above-mentioned operation is performed for 3 samples, and an average value thereof is taken as a measured value.

A small amount of an organic binder or organic fibers can also be incorporated in the molding material. Further, an expanding material such as vermiculite can also be incorporated.

As the organic binder, conventional organic binders such as a rubber, a water-soluble organic polymer compound, a thermoplastic resin, a thermosetting resin or the like may be used. Specific examples of the rubbers include a copolymer of n-butyl acrylate and acrylonitrile, a copolymer of ethyl acrylate and acrylonitrile, a copolymer of butadiene and acrylonitrile, butadiene rubber and the like. Examples of the water-soluble organic polymer compounds include carboxymethyl cellulose, polyvinyl alcohol and the like. Examples of the thermoplastic resins include a homopolymer and a copolymer of acrylic acid, an acrylic ester, acrylamide, acrylonitrile, methacrylic acid, a methacrylic ester or the like, an acrylonitrile-styrene copolymer, an acrylonitrile-butadiene-styrene copolymer and the like. The thermosetting resins include a bisphenol type epoxy resin, a novolac type epoxy resin and the like.

These organic binders can also be used as a combination of two or more thereof. There is no restriction on the amount of the organic binder used, as long as it is such an amount that the inorganic fibers can be bound, and it is from 0.1 to 12 parts by mass based on 100 parts by mass of the inorganic fibers. When the amount of the organic binder is less than 0.1 parts by mass, the binding force is insufficient. In the case of exceeding 10 parts by mass, the amount of the inorganic fibers relatively decreases to fail to obtain necessary holding performance and sealing performance. The amount of the organic binder is preferably from 0.2 to 10 parts by mass, and more preferably from 0.2 to less than 6 parts by mass.

As the organic fibers, conventional organic fibers may be used. Since the thinner and longer organic fibers have the higher binding force, highly fibrillated cellulose, cellulose nanofiber or the like is preferred.

In addition to the above-described organic binder and organic fibers, an inorganic binder can also be incorporated in the molding material. As the inorganic binder, conventional inorganic binder can be used. Examples thereof include glass frit, colloidal silica, alumina sol, silicate soda, titania sol, lithium silicate, water glass and the like. These inorganic binders can also be used as a combination of two or more thereof. There is no restriction on the amount of the inorganic binder used, as long as it is such an amount that the inorganic fibers can be bound, and it is from 0.1 to 10 parts by mass based on 100 parts by mass of the inorganic fibers. When the amount of the inorganic binder is less than 0.1 parts by mass, the binding force is insufficient. In the case of exceeding 5 parts by mass, the amount of the inorganic fibers relatively decreases to fail to obtain necessary holding performance and sealing performance. The amount of the inorganic binder is preferably from 0.2 to 6 parts by mass, and more preferably from 0.2 to less than 4 parts by mass.

Further, the holding material for a catalytic converter can be prepared by producing separately a first inorganic fiber mat material having a density of the other sites and a second inorganic fiber mat having a density of the high density sites, discontinuously forming openings having a predetermined shape in the first inorganic fiber mat material, and filling the openings with the second inorganic fiber mat material stamped out into a shape corresponding to the openings.

Alternatively, the second inorganic fiber mat material which is stamped out into a shape of the high-density sites may be bonded to a surface of the first inorganic fiber mat material. There is no restriction on a bonding method, and an adhesive or sewing may be used.

The low-density sites or the intermediate-density sites may be formed by filling openings formed in the first inorganic fiber mat material with separately prepared inorganic fiber mat material having each density or by laminating the respective material on the first inorganic fiber mat material.

Further, the invention relates to a catalytic converter provided with the above-mentioned holding material for a catalytic converter. The catalytic converter of the invention is constituted, for example, as shown in FIG. 1, by containing the above-mentioned holding material 13 for a catalytic converter in the metal casing 11 in a state where it is wound around the catalyst carrier 12, and bonding the introduction pipe 16 and the discharge pipe 17 to the metal casing.

Here, in the holding material 13 for a catalytic converter, in order to well hold the catalyst carrier 12 and to satisfy heat insulation performance and sealing performance, the density of the high-density sites is preferably from 0.35 to 09 g/cm$^3$, and more preferably from 0.45 to 0.65 g/cm$^3$, in a state mounted in the metal casing 11 (at the time of canning). Further, the density of the whole holding material is from 0.2 to 1.2 g/cm$^3$, and more preferably from 0.25 to 0.6 g/cm$^3$.

EXAMPLES

The invention will be described in more detail with reference to the following examples and comparative example, but should not be construed as being limited thereby.

Example 1

An aqueous slurry containing 0.5 part by mass of an acrylic resin as an organic binder, 3 parts by mass of colloidal silica as an inorganic binder and 10,000 parts by mass of water, based on 100 parts by mass of alumina fibers (alumina: 80% by mass, silica: 20% by mass) was obtained. Then, the slurry was poured into a mold in which concave portions square in planar shape were formed at even intervals, followed by dehydration molding to obtain a wet formed article. Then, the wet formed article was dried at 100° C. while compressing the whole wet formed article in a thickness direction to obtain a holding material in which square high-density sites were arranged in a reticular pattern as shown in FIG. 4(A). The holding material was almost even in thickness, and had an average thickness of 8 mm. The density of the high-density sites was 0.25 g/cm$^3$, the density of the other sites was 0.075 g/cm$^3$, and the density of the whole holding material was 0.1625 g/cm$^3$. Further, the total area of the high-density sites was 50% of the total surface area of the holding material.

The resulting holding material was wound around a catalyst carrier having a diameter of 110 mm, and inserted, under pressure, into a cylindrical SUS-made casing having an inner diameter of 118 mm (gap: 4 mm). At the time of insertion, the high-density sites did not act as insertion resistance, and insertion could be performed without breakage of the catalyst carrier. Further, the density of the high-density sites when being inserted into the metal casing was 0.5 g/cm$^3$, the density of the other sites was 0.15 g/cm$^3$, and the density of the whole holding material was 0.325 g/cm$^3$.

Example 2

A holding material was prepared in the same manner as in Example 1 with the exception that the depth of the concave portions of the mold was varied. The holding material was almost even in thickness, and had an average thickness of 8 mm. The density of the high-density sites was 0.27 g/cm$^3$, the density of the other sites was 0.06 g/cm$^3$, and the density of the whole holding material was 0.165 g/cm$^3$. Further, the total area of the high-density sites was 50% of the total surface area of the holding material.

Similarly, the resulting holding material was wound around a catalyst carrier, and inserted, under pressure, into a SUS-made casing. As a result, insertion could be performed without breakage of the catalyst carrier. Further, the density of the high-density sites when being inserted in the metal casing was 0.54 g/cm$^3$, the density of the other sites was 0.12 g/cm$^3$, and the density of the whole holding material was 0.33 g/cm$^3$.

Example 3

A holding material was prepared in the same manner as in Example 1 with the exception that the area of the high-density sites was varied. The holding material was almost even in thickness, and had an average thickness of 8 mm. The total area of the high-density sites was 70% of the total surface area of the holding material. Further, the density of the high-density sites was 0.21 g/cm$^3$, the density of the other sites was 0.03 g/cm$^3$, and the density of the whole holding material was 0.16 g/cm$^3$.

Similarly, the resulting holding material was wound around a catalyst carrier, and inserted, under pressure, into a SUS-made casing. As a result, insertion could be performed without breakage of the catalyst carrier. Further, the density of the high-density sites when being inserted into the metal casing was 0.42 g/cm$^3$, the density of the other sites was 0.06 g/cm$^3$, and the density of the whole holding material was 0.32 g/cm$^3$.

Example 4

A holding material was prepared in the same manner as in Example 1 with the exception that the area of the high-density sites was varied. The holding material was almost even in thickness, and had an average thickness of 8 mm. The total area of the high-density sites was 30% of the total surface area of the holding material. Further, the density of the high-density sites was 0.26 g/cm$^3$, the density of the other sites was 0.1 g/cm$^3$, and the density of the whole holding material was 0.15 g/cm$^3$.

Similarly, the resulting holding material was wound around a catalyst carrier, and inserted, under pressure, into a SUS-made casing. As a result, insertion could be performed without breakage of the catalyst carrier. Further, the density of the high-density sites when being inserted into the metal casing was 0.52 g/cm$^3$, the density of the other sites was 0.2 g/cm$^3$, and the density of the whole holding material was 0.3 g/cm$^3$.

Example 5

A holding material was prepared in the same manner as in Example 1 with the exception that the area of the high-density sites was varied. The holding material was almost even in thickness, and had an average thickness of 8 mm. The total area of the high-density sites was 15% of the total surface area of the holding material. Further, the density of the high-density sites was 0.25 g/cm$^3$, the density of the other sites was 0.14 g/cm$^3$, and the density of the whole holding material was 0.16 g/cm$^3$.

Similarly, the resulting holding material was wound around a catalyst carrier, and inserted, under pressure, into a SUS-made casing. As a result, insertion could be performed without breakage of the catalyst carrier. Further, the density of the high-density sites when being inserted into the metal casing was 0.5 g/cm$^3$, the density of the other sites was 0.28 g/cm$^3$, and the density of the whole holding material was 0.32 g/cm$^3$.

Comparative Example 1

The same aqueous slurry as in Example 1 was poured into a flat mold having no concave portion, followed by dehydration molding, compressing and drying to obtain a holding material having a thickness of 8 mm and a density of 0.16 g/cm$^3$.

Similarly, the resulting holding material was wound around a catalyst carrier, and inserted, under pressure, into a SUS-made casing. As a result, insertion could be performed without breakage of the catalyst carrier. Further, the density of the high-density sites when being inserted into the metal casing was 0.32 g/cm$^3$.

Holding Force Measurement

Figure 5:
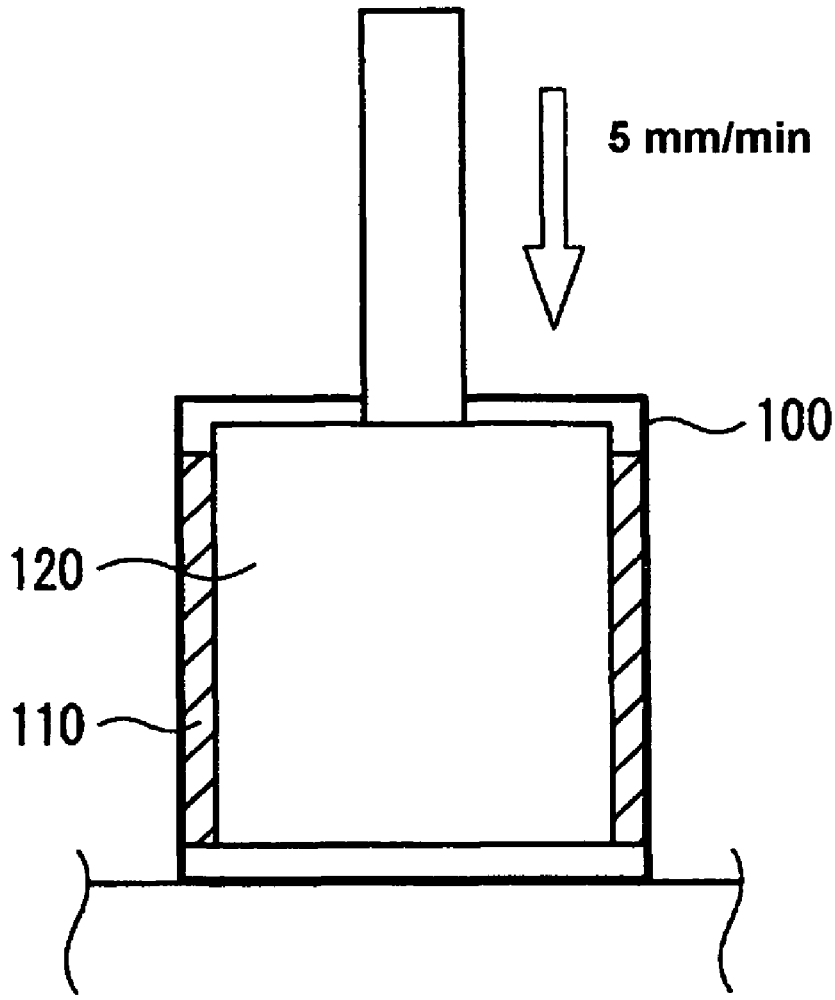
FIG. 5 is a schematic view showing a method for measuring holding force of a holding material.

The holding force was measured for the respective holding materials of Examples 1 to 5 and Comparative Example 1. Namely, as shown in FIG. 5, a catalyst carrier 120 around which a holding material 110 had been wound was placed in a cylindrical SUS-made casing 100 with a bottom portion thereof suspended, and a load was applied (5 mm/min) from an upper surface of the catalyst carrier 120. The load at the time when the catalyst carrier 120 started to move downward was measured with a load cell. As a result, it was 1250 N for the holding material of Example 1, 1320 N for the holding material of Example 2, 1290 N for the holding material of Example 3, 1100 N for the holding material of Example 4, 950 N for the holding material of Example 5, and 900 N for the holding material of Comparative Example 1. Here, from that the respective holding materials are not so much different in density, it is deduced that the amounts of the inorganic fibers which are used in the respective holding material are also not so much different. This shows that the holding materials of Examples according to the invention are excellent in holding force for the catalyst carrier, although the amounts of the inorganic fibers contained therein are approximately equal to that in Comparative Example 1. Further, as for insertion into the metal casing, the holding materials of Example 1 to 5 had no trouble, similarly to the holding material of Comparative Example 1.

What is claimed is:

1. A holding material for a catalytic converter comprising a catalyst carrier, a metal casing for receiving the catalyst carrier, and the holding material wound around the catalyst carrier and interposed in a gap between the catalyst carrier and the metal casing, the holding material having a plurality of high-density sites which are spaced apart from one another in the holding material and discontinuously arranged both in the circumferential and axial directions of the catalyst carrier, each site having a higher density than sites of the holding material in which the higher density sites are not provided and an area of at least 0.5 cm$^2$, wherein the total area of the high-density sites accounts for 20 to 70% of the total area of the holding material, a density of the high-density sites is 0.20 to 0.7 g/cm$^3$, and a thickness of the holding material is adjusted within +15%.

2. The holding material according to claim 1, which has a constant thickness.

3. The holding material according to claim 1, which has a thickness of 5 to 30 mm and a density as the whole holding material of 0.1 to 0.6 g/cm$^3$.

4. A catalytic converter comprising a catalyst carrier, a metal casing for receiving the catalyst carrier, and a holding material wound around the catalyst carrier and interposed in a gap between the catalyst carrier and the metal casing, the holding material having a plurality of high-density sites which are spaced apart from one another in the holding material and discontinuously arranged in both the circumferential and axial directions of the catalyst carrier, each site having a higher density than sites of the holding material in which the higher density sites are not provided and an area of at least 0.5 cm$^2$, wherein the total area of the high-density sites accounts for 20 to 70% of the total area of the holding material, a density of the high-density sites is 0.20 to 0.7 g/cm$^3$, and a thickness of the holding material is adjusted within +15%.

* * * * *